US005460781A

United States Patent [19]

Hori et al.

[11] Patent Number: 5,460,781

[45] Date of Patent: Oct. 24, 1995

[54] HEMOGLOBIN SAMPLER

[75] Inventors: Hironobu Hori; Norigi Kurihara; Mitsushi Gotanda; Takayuki Yanagiya; Atsushi Umetani, all of Tokyo, Japan

[73] Assignees: Fujirebio Kabushiki Kaisha; Aubex Corporation, both of Japan

[21] Appl. No.: 669,079

[22] Filed: Mar. 12, 1991

Related U.S. Application Data

[63] Continuation-in-part of Ser. No. 427,543, Oct. 27, 1989, abandoned.

[51] Int. Cl.[6] ..... B01L 3/00

[52] U.S. Cl. ..... 422/99; 422/100; 436/810; 435/309.1; 73/863; 73/864.72; 401/198

[58] Field of Search ..... 422/99, 100; 436/810; 435/292; 73/863, 863.23, 864.72; 401/198; 428/295, 375

[56] References Cited

U.S. PATENT DOCUMENTS

| | | | |
|---|---|---|---|
| 3,480,372 | 11/1969 | Kenny et al. | 401/198 |
| 4,119,756 | 10/1978 | Midorikawa | 428/295 |
| 4,269,526 | 5/1981 | Dupre | 401/198 |
| 4,334,879 | 6/1982 | Fujimori . | |
| 4,562,043 | 12/1985 | Mennen et al. | 128/749 |
| 4,582,811 | 4/1986 | Pucci et al. | 436/548 |
| 4,635,488 | 1/1987 | Kremer | 422/58 |
| 4,749,618 | 6/1988 | Kawaguchi et al. | 428/375 |
| 4,789,639 | 12/1988 | Fleming . | |
| 4,908,340 | 3/1990 | Frechette et al. . | |

FOREIGN PATENT DOCUMENTS

| | | |
|---|---|---|
| 59-182367 | 10/1984 | Japan . |
| 62-69160 | 3/1985 | Japan . |
| 61-228351 | 10/1985 | Japan . |
| 61-102941 | 5/1986 | Japan . |
| 1452206 | 10/1976 | United Kingdom . |

OTHER PUBLICATIONS

"The Condensed Chemical Dictionary" by Van Nostrand Reinhold Company Inc. (1981), p. 926.

Brushes International, vol. 60, No. 709, pp. 23–24, Jan. 1974.

*Primary Examiner*—David A. Redding

*Attorney, Agent, or Firm*—Lowe, Price, LeBlanc & Becker

[57] ABSTRACT

A hemoglobin sampler for use with stool samples for clinical tests and diagnoses of the digestive tract diseases in mass screening, etc. by securely sampling and collecting occult hemoglobin with water content from the stool samples without being hindered by the undigested solid content of stools. The sampler has a core member consisting of a porous fiber bundle made up of a plural number of synthetic fibers bundled in the longitudinal direction thereof, a rod of a suitable length provided with a thermosetting synthetic resin sheath at the outer periphery of the core, one end of the rod forming a sample absorbing member with a suitable surface area and small diameter made up of the above mentioned porous fiber bundle. The sampler can quantitatively sample occult hemoglobin with water from stool samples of various properties, thereby offering an easy sample method for the subject and stable specimen for tests. Thus, the utility of the test method can be fully exerted and the sampler is quite useful for clinical tests and mass health screening.

8 Claims, 1 Drawing Sheet

HEMOGLOBIN SAMPLER

This application is a continuation-in-part of patent application Ser. No. 07/427,543, filed on Oct. 27, 1989 now abandoned.

TECHNICAL FIELD

The present invention relates to a hemoglobin sampler, and more particularly to a hemoglobin sampler for collecting occult hemoglobin in the stool sample without being hindered by undigested solid contents in the stool, etc. for use in clinical tests or mass health screening for diagnosis of digestive tract diseases.

BACKGROUND

In the prior art, the chemical occult blood test or the immunological occult blood test are known as the methods for simply and easily detecting abnormalities in the digestive tract such as the stomach or intestine. According to these methods, stool samples are taken from subjects, and sensitivity of the reagent is adapted to the anticipated amount of stool. The sample must be in the precise amount to achieve the best result; if it is too little or too much, the reagent does not react and the amount must be adjusted. As the sample contains solids, unpleasant odors and extra disposal steps are necessarily involved.

As such prior tests require the subject to collect his/her own stool, there have been developed various tools for this purpose.

For example, Japanese UM application laid open as Sho 62-69160 discloses a sampling stick at one end of which is formed a throughhole and the like in the direction perpendicular to the axis of the stick. As the end of the sampling stick is thrust into the stool sample, a small amount of stool adheres in and around the hole. This sampler is defective in that its shape is unsuitable for collecting watery stool samples; it essentially requires a filter for filtrating the solid content; it requires dexterity on the part of the subject in collecting just the precise amount of sample in order to prevent errors in judging results; and it inconveniently involves extra steps of suspending the sample in physiological saline and filtrating the same, thus imposing much burden on the subjects and those conducting the test.

Japanese Patent Application laid open as Sho 59-182367, on the other hand, discloses a diagnostic tool consisting of a carrier for absorbing/adsorbing monoclonal antibody specific to human hemoglobin on the surface of a dip stick in order to detect trace blood in the stool samples. This diagnostic tool requires an additional step in manufacture for absorption/adsorption of monoclonal antibody at the end of the dip stick. There is always a doubt about whether or not the carrier sufficiently absorbed/adsorbed monoclonal antibody. In addition, the cited art requires extra steps of filling the stool sample inside the cavity formed at the tip of the carrier and of washing the sample away with water, thus proving complex and inconvenient.

Japanese Patent Application laid open as Sho 61-228351 discloses a sampling spoon provided with latticed notches on the surface of a polymer material (particularly hydrophobic plastic resin). After the stool is collected and attached to the surface of the sampling spoon, the spoon is left standing for a prescribed period of time in a buffered solution adjusted to interfere with the activities of digestive enzymes in the stool and to adsorb hemoglobin on the spoon surface.

As the sampling spoon used in this method is made of a hydrophobic plastic material, it cannot be used for sampling all types of stools, especially watery ones. At the same time, solid stool caught in the latticed grooves must be completely discharged into the buffer solution in order to carry out the subsequent processes smoothly.

The present inventors assiduously worked in order to offer a hemoglobin sampler which obviates these problems of conventional samplers and which can be used to sample hemoglobin alone from any forms or types of stools simply, easily and in precise quantities without unpleasant odors and in a clean manner. The inventors have come up with an idea of sampling hemoglobin alone by using the capillary action, and conducted experiments. As a result of such experiments, the inventors have learned that the material and shape of a hemoglobin sampler affect the success in sampling.

U.S. Pat. No. 4,789,639 discloses the method of immersing the absorbent pad of a swab in the liquid in a container and then collecting only the minimum amount of liquid by pulling the pad through a hole of a size substantially the same as the pad. The pad is made of a cotton swab and comprises a shaft attached with a relatively soft mass of randomly entangled fibers, the mass being larger than the shaft diameter at the end thereof. The device, however, is inconvenient as an increasingly large force is required to squeeze out the sampled liquid corresponding to the decrease in the liquid amount.

The sampling process consists of immersing and squeezing the sample. This means that sampling solid or relatively soft stools is quite difficult. A large amount of undigested solids in the stool attach to the enlarged portion of the absorbent pad or between the fibers, thus interfering with the effective sampling of hemoglobin in the stool.

U.S. Pat. No. 4,334,879 discloses an applicator for uniformly applying with pressure the liquid sample in a fine straight line on the cellulose acetate film, the applicator tip being made of a liquid absorbing porous body such as foam plastic, foam rubber or ceramics. This applicator is used only for sampling the liquid and for uniformly applying the liquid sample in a straight line on a prescribed surface. It is not suitable for sampling hemoglobin out of the stool samples. The applicator has an applicator blade made of a porous material which is immersed in the liquid sample, and then pressed under pressure onto the support to apply the sample. If the porous body does not become deformed by the pressing operation, uniform application cannot be made as the liquid does not seep out of the pores of the porous body onto the support. Thus, a hard material such as ceramics is not suitable for application under pressure.

Use of fine sintering particles generally provides a smooth surface but not continuous pores in the ceramics. If gross particles are used to form continuous pores, the texture becomes brittle and the surface rough. The former cannot quite absorb the liquid, and therefore notches must be cut as in the above mentioned conventional samplers. In the latter, a number of small pores are formed in the ceramic by the irregular surface of sintered particles, thus lacking directivity for the capillary action and delaying the absorbing rate of the liquid.

Foam plastics and rubber are made up of numerous cells which generally have large diameters and extremely thin cell membranes compared to their diameter. Thus, they lack directivity for the capillary action, and have weak absorbing force although it can be impregnated with or maintain the liquid.

These porous bodies are, therefore, not useful for sampling soft watery stools or hard stools with little water content, because they tend to absorb undigested solids rather than the water in stool.

The present invention was completed as a result of a series of studies to obviate the above mentioned problems. It offers a hemoglobin sampler for sampling and collecting the liquid content alone from hard stools containing a relatively small amount of water, soft stools containing relatively large amounts of water, or watery stools, and trapping occult hemoglobin in the stool while preventing the solid content from mixing into the sample.

DISCLOSURE OF THE INVENTION

The hemoglobin sampler according to the present invention comprises a core section of a porous material consisting of a bundle of a,number of synthetic fibers in the longitudinal direction thereof, a rod of a suitable length formed over the outer periphery of the core section by providing a sheath made of thermoplastic resin, and a sampling section provided at one end of the rod consisting of said porous fiber bundle of a smaller diameter and a suitable surface area. The sampler is characterized in that it can sample and collect occult hemoglobin with water from stool samples of different properties.

According to the present invention, a porous fiber bundle comprising the core section is formed by a plural number of synthetic fibers in the vertical direction bound with an adhesive or a binder.

The porous fiber bundle has capillary tubes formed randomly along the vertical direction by comparatively large interstices of 10 to 50 um formed by contacts/non-contacts of synthetic fibers extending in the longitudinal direction and infinitesimal V grooves occurring by the mutual contact of fibers. These capillary tubes demonstrate excellent capillary actions from one end to the other end of the porous fiber bundle to allow the rapid climb of the liquid and to adjust the height thereof by the thickness and density of synthetic fibers.

The thickness of the synthetic fibers should not exceed 10 deniers in terms of single yarn because if the interstices are too large, wiping off the undigested solid content becomes difficult. Therefore, the thickness is preferred to be within the range of 2 to 6 deniers.

The density of the synthetic fibers can be adjusted suitably to the sensitivity of the reagent within the range of 30–70% in terms of porosity of porous fiber bundle. If the porosity is increased and the thickness of single yarn decreased, the number of fibers is increased to improve the sampling performance.

As the synthetic fibers, thermoplastic synthetic fibers are preferred because of their excellent molding property, i.e. polyester fibers such as polyethylene terephthalate with low polarity, or single or conjugate olefin fibers such as polyethylene or polypropylene.

The sheath at the outer periphery of said core member is formed in order to prevent seeping or infiltration of the liquid at the outer peripheral surface of porous fiber bundle. The outer surface should preferably have a surface sufficiently smooth to enable wiping the liquid off and a relatively small thickness.

The following methods are conceivable for forming the sheath at the outer periphery of the core member.

1. Thermoplastic synthetic fibers are used to form the porous fiber bundle as the core, and the outer periphery of thus obtained porous fiber bundle is heated and fused to obtain a thermally fused layer of high density and small thickness as a sheath.

2. Thermoplastic synthetic resin is coated over the outer periphery of the porous fiber bundle core to form a thin coating layer for the sheath.

3. Heat-shrinkable tube made of thermoplastic synthetic resin is fit over the porous fiber bundle core, and the coating layer is formed into a sheath by applying heat to said heat shrinkable tube.

The rod provided with a sheath over the outer periphery of the porous fiber bundle is cut into a suitable length, one end of which is ground to remove the sheath and to form a semi-spherical end portion with smooth surface and small diameter. This small diameter section is used to absorb the sample.

The sample absorbing section can be given a suitable surface area and pore volume by determining the diameter and length of the porous fiber bundle with due consideration to the water content of the sample absorbed, the sensitivity of the detection reagent, and dispersion/dissociation activities in the buffer solution.

If the diameter of the porous fiber bundle is made minimal, the pore volume of the sample absorbing section can be reduced to less than 1 μl. If it is set in the range of 5 μl to 70 μl, the small diameter section can be molded to the dimensions of 1.5–5 mm in diameter and 5–7 mm in length, and the rod diameter to about 2–5.5 mm. These dimensions are extremely convenient for handling by the subject and for sampling and capturing occult hemoglobin.

The hemoglobin sampler according to the present invention is provided with a semi-spherical sample absorbing section. When said section is stuck into several points of the stool sample, the capillary tubes formed by the porous fiber bundle with semi-spherical ends act to absorb the water content and occult hemoglobin from the stool sample along the fibers.

Undigested solid contents in stools which had adhered to the sample absorbing section can easily and cleanly be wiped off because of absence of irregularities on the surface of the sample absorbing section particularly as the water content is absorbed.

The absorbing section removed of any undigested solids becomes so clean that stool scales are not visible and the absorbed water may be used as the sample water content.

When the sample absorbing section which has absorbed the water content from the sample is placed inside the buffer solution, the water content and occult hemoglobin of the sample become dissociated from the semi-spherical ends by the osmotic pressure of the liquid contacting the small diameter member and dispersed, thereby obtaining the sample solution without the secondary filtration.

It is possible for the subject to use the present invention sampler without any psychological burdens over his own stools whether they are hard, soft or watery.

This results in remarkable reduction of fluctuation in the sampled amounts depending on the subjects which are often encountered in the case of conventional samplers. It also minimizes the variation in the sampled amounts due to the properties of the stools.

As there is no need to handle the stools, the transport and storage thereof do not entail unpleasant odors. As the filtration step is not required, the samples may be prepared in short period of time and a large number of samples may be handled in one operation.

BRIEF DESCRIPTION OF THE DRAWINGS

An embodiment of the present invention hemoglobin sampler is explained referring to the attached drawing.

BEST MODE FOR CARRYING OUT THE INVENTION

Figure 1:
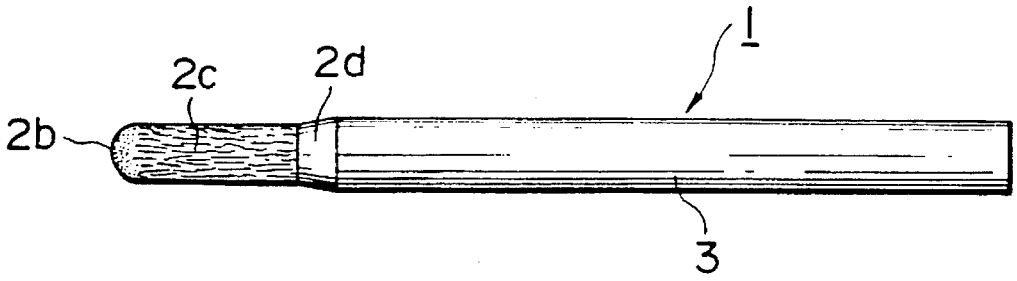
FIG. 1 is a plan view showing one embodiment of a hemoglobin sampler according to the present invention.

The hemoglobin sampler 1 in FIG. 1 comprises a rod 2 of the predetermined length, a sheath 3 consisting of a heat-fused layer at the outer periphery of the rod 2, and a sample absorbing section 2*c* of a small diameter at one end of the rod 2.

Figure 2:
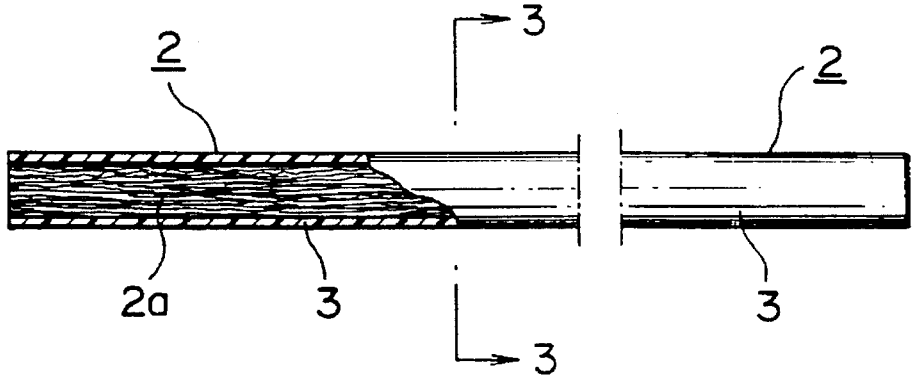
FIG. 2 is a partially exploded front view of a rod of the hemoglobin sampler according to the present invention.
Figure 3:
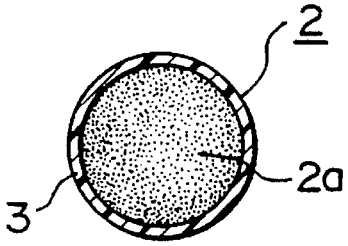
FIG. 3 is a cross sectional view along the line A—A in FIG. 2.

The hemoglobin sampler 1 is a rod 2 manufactured by the steps of bundling in the longitudinal direction and heating 17,000 denier crimped fiber and 5 denier single fiber polyester filament tows shown in FIG. 2, impregnating said tows with polyurethane adhesive containing solid at 16 wt %, curing and drying the tows to form a porous bundle of continuous fibers 2*a*, heating and fusing the outer peripheral surface of the bundle 2*a* to form a sheath 3 consisting of about 0.1 mm thick fused layer, grinding the irregularities from the outer peripheral surface of the sheath 3 to obtain the rod of 1.95 mm diameter circular cross section and cut into 50 mm length. One end of the rod 2 is grounded for the length of 5 mm in order to form a small diameter section 2*c* having a semi-spherical end 2*b* of 1.7 mm diameter and porous volume of about 5 μl to absorb the sample.

The hemoglobin sampler 1 thus obtained is so structured that the sample absorbing part comprising of the small diameter section 2*c* is made up of a porous fiber bundle by bundling a plurality of synthetic fibers in the longitudinal direction, and that the porous fiber bundle extends from the end of the small diameter section 2*c* to the other end of the rod along its vertical axis to enhance its capillary action. Thus, it is possible to sample and capture hemoglobin and water content for the test even from hard stool samples with little water content.

As shown in FIG. 1, since the portion connecting the small diameter section 2*c* and the sheath 3 forms a gradually inclining shoulder 2*d* and the surface of the sheath 3 is ground smoothly not to absorb the water, it is possible to wipe clean any stools that adhere to the outer surface of the small diameter section 2*c* and the sheath 3 near the section 2*c* with a piece of tissue, etc.

In the embodiment, the shoulder member 2*d* smoothly connects the small diameter section 2*c* and the sheath 3, but the shoulder member 2*d* may be replaced with a small stepped portion, and the end of the section 2*c* may be made conical instead of semi-spherical.

The hemoglobin sampler according to the above mentioned embodiment was used in collecting the water content from several stool samples. The samplers could be wiped clean without leaving any marks of stool scales.

The sample absorbing section which absorbs and maintains the sample were then placed in the dilutions of reagents, and hemoglobin from the solutions in which the samples were dispersed and dissociated was determined by using a reagent for detecting hemoglobin (Immedea-HemSp sold by Fujirebio Kabushiki Kaisha or Hemselect sold by Smith Kline Diagnostics, Inc. in the U.S.)

Table 1 shows the results. The determination was performed by following the R-PHA (Reversed Passive Hemagglutination) method.

In the table the figures given as data indicate the dilution of samples given as $2^n$ based on a sample which gives rise to agglutination with the reagent at a predetermined concentration. An indication $\leqq 2$, for example, means the dilution is smaller than $2^2$, and $\geqq 13$, greater than $2^{13}$. The hemoglobin level in the table means the level in the samples, showing an extremely high correlation therebetween.

TABLE 1

| | Sample No. | | | | | | | |
|---|---|---|---|---|---|---|---|---|
| Hemoglobin level | 1 | 2 | 3 | 4 | 5 | 6 | 7 | 8 |
| 100 ng/ml | <2 | <2 | <2 | <2 | <2 | <2 | <2 | <2 |
| 1 μg/ml | 2 | 2 | 2 | 2 | 2 | 2 | 2 | 2 |
| 10 μg/ml | 4 | 5 | 4 | 5 | 5 | 5 | 4 | 5 |
| 100 μg/ml | 8 | 7 | 7 | 8 | 7 | 8 | 8 | 8 |
| 1 mg/ml | 11 | 10 | 11 | 11 | 10 | 11 | 11 | 11 |
| 10 mg/ml | >13 | >13 | >13 | >13 | >13 | >13 | >13 | >13 |

The hemoglobin sampler according to the present invention comprises a core member consisting of a porous body of a number of a synthetic fiber bundle in the longitudinal direction thereof, a rod of a suitable length formed over the outer periphery of the core member by providing a sheath made of thermoplastic resin, and a sample absorbing member provided at one end of the rod consisting of said porous fiber bundle of a smaller diameter and a suitable area. The sampler is characterized in that it can sample and collect the water content from stool samples containing various degrees of water.

According to the present invention, the samples can be collected irrespective of subjects who are taking the samples, and help to achieve effective validity for detection of hemoglobin as the samples thus obtained are quite stable and can be used advantageously in clinical examinations and mass screenings.

Even when stool scales have adhered to the sampler at the time of sample collection, the scales can be simply and easily wiped off without damage to the samples, thereby securely preventing the undigested solid content from mixing in the samples and eliminating the secondary steps such as filtrating to improve the test efficiency.

We claim:

1. A hemoglobin sampler for stool, comprising a rod of a suitable length, said rod samples comprising a core member formed of a porous fiber bundle of longitudinally oriented thermoplastic synthetic fibers bound with each other in the longitudinal direction thereof, said core member having (i) capillary tubes between adjacent fibers, said capillary tubes being distributed randomly along the entire length of said bundle, and (ii) a cover made of thermoplastic resin arranged around the core member for tightly covering the core member, said cover extending longitudinally along said core member except for one end of the core member, said one end of the core member forming a sample absorbing section for sampling occult hemoglobin with water from stool samples of different properties, said porous fiber bundle having a porosity of 30 to 70%, and said sample absorption section having a pore volume of 5 to 70 μl.

2. The hemoglobin sampler for stool samples as claimed in claim 1 wherein said porous fiber bundle consists of thermoplastic synthetic fibers of single yarns not exceeding 10 deniers.

3. The hemoglobin sampler for stool samples as claimed in claim 1 wherein said cover is no greater than 0.1 mm thick.

4. The hemoglobin sampler for stool samples as claimed in claim 1 wherein said cover consists of a thermally fused layer of synthetic fibers at the outer periphery of the porous fiber bundle.

5. The hemoglobin sampler for stool samples as claimed in claim 1 wherein said cover consists of a coating layer of thermoplastic synthetic resin.

6. The hemoglobin sampler for stool samples as claimed in claim 1 wherein said cover consists of a heat shrinkable tube of synthetic resin.

7. The hemoglobin sampler for stool samples as claimed in claim 1 wherein the sample absorbing section of the porous fiber bundle of said rod has a hemispherical end.

8. The hemoglobin sampler for stool samples as claimed in claim 1 wherein said rod member has an outer surface sufficiently smooth to enable wiping off of the stool adhered to the outer periphery thereof.

* * * * *